United States Patent [19]

Goncalves

[11] Patent Number: 4,781,484

[45] Date of Patent: Nov. 1, 1988

[54] APPLICATION UNIT REQUIRING AUTOMATIC ADDITION OF AT LEAST ONE ADDITIVE UPON FIRST USE

[75] Inventor: Antonin Gonçalves, Groslay, France

[73] Assignee: L'Oreal, Paris, France

[21] Appl. No.: 14,386

[22] Filed: Feb. 13, 1987

[30] Foreign Application Priority Data

Feb. 17, 1986 [FR] France ..... 86 02073

[51] Int. Cl.[4] ..... B05C 17/00

[52] U.S. Cl. ..... 401/132; 401/4; 401/40; 401/134; 401/129; 604/3

[58] Field of Search ..... 401/132, 134, 135, 41, 401/4, 40, 129; 604/1-3

[56] References Cited

U.S. PATENT DOCUMENTS

| | | | |
|---|---|---|---|
| 1,607,768 | 11/1926 | Meusel | 401/41 |
| 3,311,941 | 4/1967 | Buchwalter et al. | 401/4 |
| 3,336,624 | 8/1967 | Schefer et al. | 401/4 |
| 3,349,966 | 10/1967 | Schwartzman | 401/41 |
| 3,355,238 | 11/1967 | Schwartzman | 401/41 |
| 3,399,019 | 8/1968 | Koelichen | 401/134 |
| 3,482,920 | 12/1969 | Schwartzman | 401/132 |
| 3,640,268 | 2/1972 | Davis | 601/1 X |
| 3,773,035 | 11/1973 | Aronoff et al. | 401/134 X |
| 3,918,435 | 11/1975 | Beall et al. | 604/2 X |

FOREIGN PATENT DOCUMENTS

| | | |
|---|---|---|
| 2211753 | 1/1972 | Fed. Rep. of Germany . |
| 1418477 | 10/1965 | France . |
| 1568362 | 5/1969 | France . |
| 2270163 | 12/1975 | France . |
| 450943 | 5/1968 | Switzerland . |

OTHER PUBLICATIONS

French Search Report Oct. 27, 1986.

*Primary Examiner*—Steven A. Bratlie
*Attorney, Agent, or Firm*—Cushman, Darby & Cushman

[57] ABSTRACT

The storage and dispensing unit comprises a container, a stoppering device and an applicator device. The stoppering device comprises a sleeve wherewith it is fitted on to the container and which carries the applicator device, and a closing cap comprising an external skirt surrounding the sleeve and an internal skirt delimiting with a top a compartment for an additional product intended to be added to that contained in the container.

The cap is capable of displacement in relation to the sleeve, a bead of the skirt being disengaged from a groove of the sleeve for catch engagement in another groove, the skirt sliding in a leakproof manner around a skirt of the device, and a perforator of the cap coming during this action to pierce a foil which is carried by the device and closes the compartment, for the additional product to drop to allow the additional product into the container through the openings of the applicator device. The device is usable for the storage of nail varnish.

7 Claims, 2 Drawing Sheets

APPLICATION UNIT REQUIRING AUTOMATIC ADDITION OF AT LEAST ONE ADDITIVE UPON FIRST USE

FIELD OF THE INVENTION

The present invention relates to a storage and application unit comprising a reservoir containing a substance of liquid to pasty consistency and a detachable stoppering device intended to close the reservoir and which constitutes a holding member allowing manipulation of an applicator element carried by the end of a stem integral with the stoppering device. In the closed condition of the reservoir, the stem and the applicator element associated therewith are immersed in the reservoir. When the stem is withdrawn from the reservoir, a certain quantity of the product is taken up on the applicator element, and can then be applied to a base.

PRIOR ART

Examples of such units include bottles of nail varnish whose applicator element is constituted by a small brush, the stoppering device being constituted by a cap fitted on the neck of the bottle and having a stem carried by a capsule which is force-fitted in the opening of the said cap; by bearing on the upper edge of the neck of the bottle the capsule ensures leakproof stoppering which is necessary in this case because of the presence of volatile constituents in the nail varnish.

In the case of units of the above-mentioned type, the present invention provides an advantageous solution for the following problem:

It may be desired to add to the product contained in the reservoir, with a view to enhancing its utilisation, at least one additional product such as an agent contributing a complementary or synergistic effect, the additional product or products not being stable in the basic product, at least over the relatively long periods generally elapsing between manufacture and use, particularly in view of the storage time on the retailers' premises.

The solution of storing the products separately does not appear to be ideal; moreover, it is not always possible to mix products coming from different containers, and in any case, this may be inconvenient.

OBJECT OF THE INVENTION

It is therefore an object of the present invention to provide a storage and dispensing unit in which the additional product (or products) can be stored inside the device for stoppering the container of the basic product, such that the first opening actuation of the container automatically causes the additional product (or products) to drop into the basic product.

SUMMARY OF THE INVENTION

In accordance with the invention, the stoppering device is made of two parts, the first part enabling the device to be fitted on the container and carrying the applicator device, and the second part comprising at least one compartment for at least one additive and being displaceable in relation to the first by a simple action between a storage position, wherein the additional product (or products) cannot escape from its compartment (or their compartments), and a second position wherein the said compartment (or compartments) are caused to communicate with the interior of the container, the stoppering device being, during this operation, maintained in the position where it closes the container.

In these conditions the mixing of various mixed products only takes place over a short period of time, that is to say only during the period of use, and the mixing of the products does not require any manipulation, except the very simple action of displacing the second part of the stoppering device in relation to the first at the time of the first use.

Clearly, the present invention also applies to the case where the additional product (or products) would only be stable in the basic product over a very short time in which case the container would constitute a dose whose contents would in its entirety be usable once only.

The present invention therefore provides a new industrial product constituted by a unit for the storage, and the application onto a base, of a product with liquid to pasty consistency comprising, firstly, a reservoir containing the product and, secondly, a detachable stoppering device which is fitted on the reservoir and is integral with an applicator device comprising a stem terminating in an element enabling the product to be taken out of the container, to be carried and to be spread on a said base, the stoppering device comprising means, complementary to further means carried by the container, for ensuring the stoppering seal of the container, characterised in that the stoppering device consists of two parts, that is to say, a first part which comprises the means for fitting it on the container and having the applicator device integral therewith, and a second part delimiting at least one compartment for at least one additional product intended to be admixed to the product contained in the reservoir at the time of the first use and which is capable of being displaced manually by the user in relation to said first part in order to pass before the first use of the unit from a first or storage position in which the or each compartment is obturated in a leakproof manner, into a second or final use position in which each said compartment has opened to cause said compartment to communicate with the interior of the reservoir and to allow the contents of the compartment to fall into the reservoir during the above-mentioned action, means being provided for fixing said first and second parts of the stoppering device to each other when they are placed into said final use position with a view to withdrawing said stoppering device for use of the product combined with the or each said additional product.

The unit in accordance with the present invention advantageously comprises means for preventing untimely actuation of the second part of the stoppering device during storage, before its first use.

In accordance with a preferred feature of the present invention, a perforator is associated with the or each compartment for opening of the compartment containing the at least one additional product and is capable of coming, during the action placing the second part of the stoppering device into the final use position, to pierce a film obturating the associated compartment, the arrangement being such that a said perforator associated with a said compartment is carried by one of the first and second parts and a said film associated with the same said compartment as that perforator is carried by the other of said first and second parts of the stoppering device, there being at least one communication opening between the compartment (or compartments) with the perforated foil and the reservoir.

The first part of this stoppering device advantageously consists of a sleeve having the applicator device disposed therein and integral therewith, the sleeve comprising in its lower portion means for fitting it on the reservoir, the second part of the stoppering device consisting advantageously of a closing cap comprising a peripheral skirt joined to a top, the peripheral skirt being capable of sliding in relation to the sleeve in the upper region of the sleeve and comprising means complementary to further means carried by the sleeve for the attachment of the cap on the sleeve in the storage position and, subsequently after the action of lowering the cap, in the final use position.

Preferably the complementary attachment means consist of an annular bead of the peripheral skirt of the cap and two parallel grooves on the sleeve.

The peripheral skirt of the closing cap can be external to the sleeve, and the means preventing untimely actuation of the cap during storage before the first use then advantageously consist of an easily frangible integrity ring situated in the extension of the skirt and bearing at its lower end on a flange of the sleeve.

In the case where the stoppering device is screw-fitted the reservoir, the means for fixing the first and second parts of the stoppering device to each other in the final use position, to facilitate withdrawal of the stoppering device, consist of splines carried respectively by the peripheral skirt of the cap and by the sleeve and being capable of interengaging in the final use position.

Advantageously, the or each opening capable of communicating the interior of the or each compartment containing the at least one additional product is arranged in the applicator device, in the transition zone between the stem and the first part of the stoppering device.

The said unit may advantageously comprise a single compartment for a single said additional product, this single compartment being delimited by the bottom and by an internal skirt of the closing cap, the applicator device comprising in its transition zone between the stem and the sleeve, a skirt capable of sliding in a leakproof manner in relation to the internal skirt of the cap.

This skirt of the applicator device may particularly advantageously be joined to an annular projection to which there is applied a film obturating the compartment for the additional product, the top of the cap comprising a perforator capable of piercing the foil and the projection being joined to the stem of the applicator device by a wall comprising the or each opening to communicate the compartment for the additional product with the interior of the container.

The above-mentioned skirt of the applicator device can terminate on the opposite side to the projection in an annular flange which effects the stoppering seal of the reservoir, the flange cooperating with a ring of the sleeve for fixing the sleeve to the applicator device.

BRIEF DESCRIPTION OF THE DRAWINGS

In order that the present invention may more readily be understood an embodiment, represented in the attached drawings, will be described below by way of a purely illustrative and non-restrictive example.

In these drawings.

DESCRIPTION OF THE PREFERRED EMBODIMENT

Figure 1:
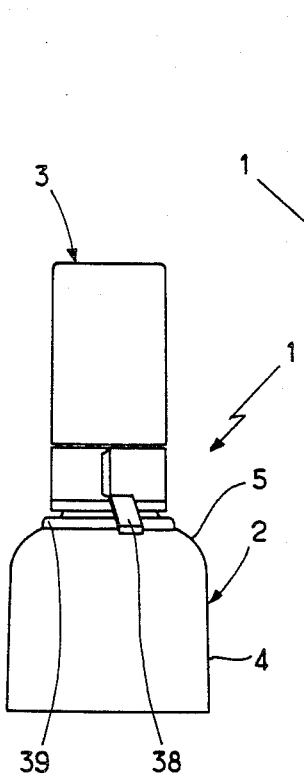
FIG. 1 is an elevational view of a closed bottle of nail varnish in accordance with the present invention, in the form assumed before the first use, that is to say, when the integrity ring or tamper evidence ring is still in position.

Referring to the drawings, there will be seen a unit 1 for separate storage of a nail varnish and of a treatment substance for nails which is intended to be mixed with the varnish on the occasion of the first use of the varnish. As may be seen in FIG. 1, the unit 1 substantially takes the form of a conventional nail varnish bottle.

Figure 2:
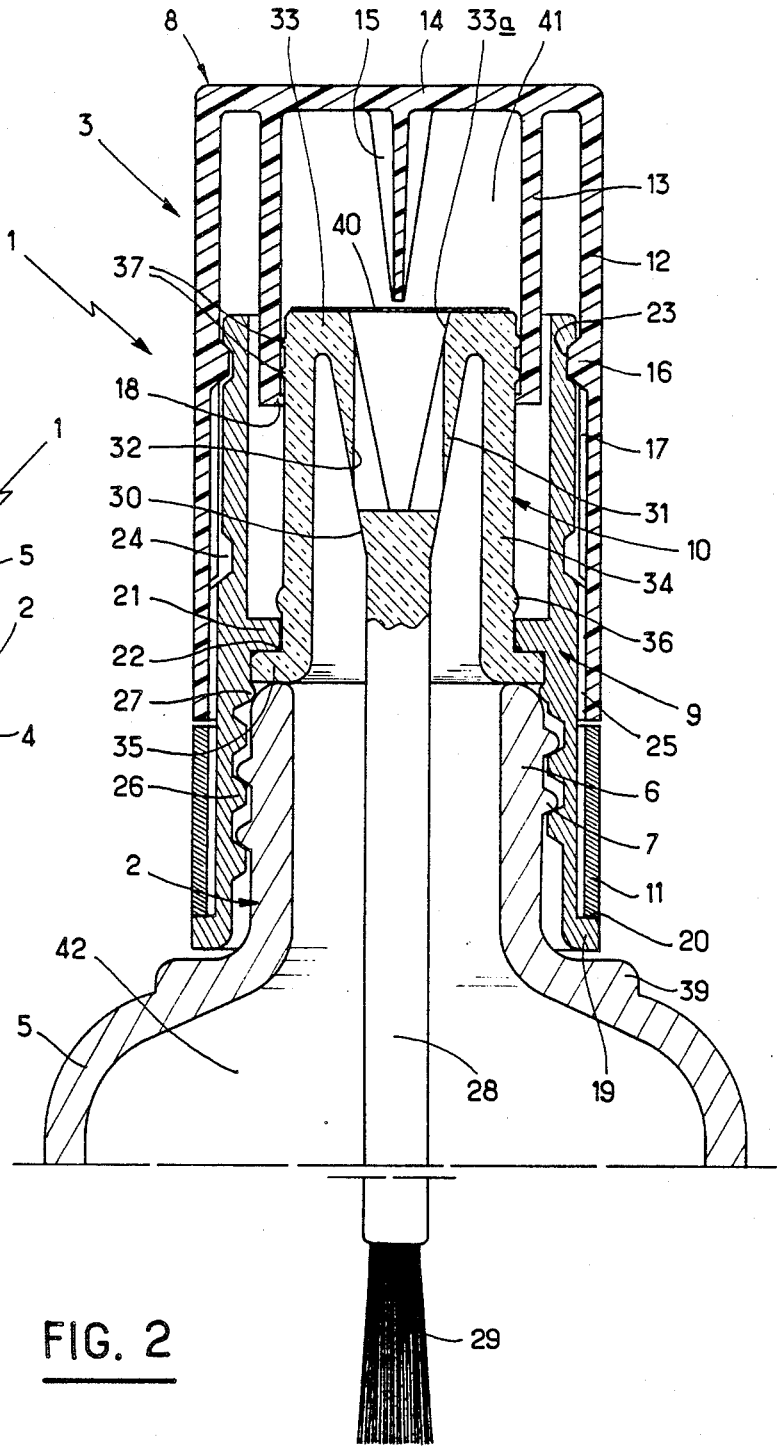
FIG. 2 is an axial cross-sectional view of the bottle of FIG. 1, of which only the upper portion has been shown.
Figure 3:
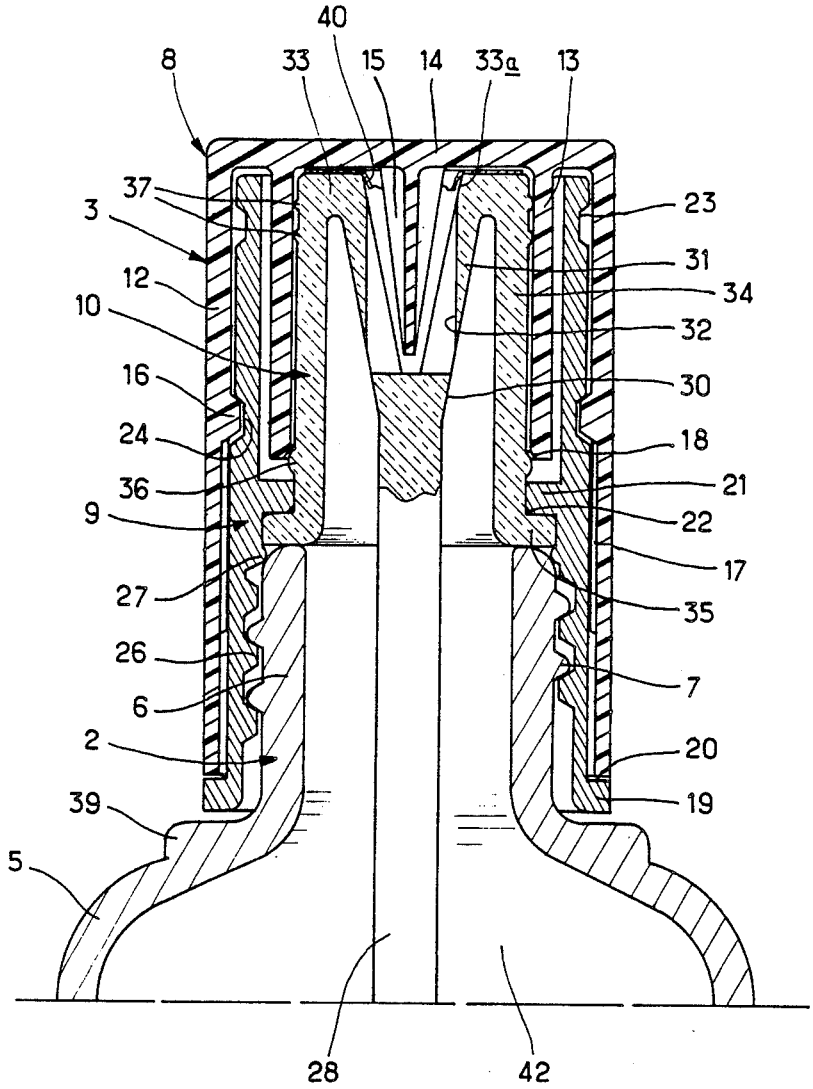
FIG. 3 is a view similar to FIG. 2 but showing the bottle in the closed condition which it occupies after the integrity ring has been removed.

The unit 1 is constituted by a reservoir or bottle 2 having associated therewith a stoppering device 3 which is represented in greater detail in FIGS. 2 and 3.

The bottle 2 is made of glass and comprises a body 4 which is joined at its upper portion via a shoulder 5 to a neck 6 whose cylindrical wall carries an external thread 7.

The stoppering device 3 comprises a closing cap 8 carrying, on the one hand, a sleeve 9 and, on the other hand, an applicator device 10. This stoppering device 3 is completed by an easily frangible integrity or tamper evidence ring 11 which needs to be broken to permit the first use of the unit 1.

The closing cap 8, of a flexible and possibly transparent plastic material, is constituted by two coaxial cylindrical skirts 12 and 13, joined to a flat top 14 which carries a perforator disposed along the axis of the closing cap 8. The function of the perforator 15 will be indicated below.

As may be seen in FIGS. 2 and 3, the external skirt 12 of the cap 8 comprises internally, approximately midway between its top 14 and its free edge, but slightly nearer the top 14, an annular bead 16 of trapezoidal cross-section. The thickness of the skirt 12 is larger between the cap top 14 and the bead 16 than between the bead 16 and free edge of the skirt. Moreover, the skirt 12 has internally, in its thinner region and starting from the bead 16, longitudinal splines 17 which extend up to a certain distance from the free edge of the skirt 12. In the region of a spline 17, the thickness of the skirt 12 is substantially similar to that which it has in the region between the cap top 14 and the bead 16. Moreover, as may be seen in particular in FIG. 2, the splines 17 have at their lower ends a rapidly decreasing thickness.

The internal skirt 13 of the cap has its free internal edge 18 chamfered and is shorter than the external skirt 12 because it extends only slightly beyond the bead 16.

In its lower portion the sleeve 9, made of a plastic material and consisting of a tubular element, is bent at right angles at flange 19 over a short distance. The upper annular wall 20 of this flange 19 constitutes a bearing surface for the integrity ring 11 as will be described below.

Approximately midway between the flange 19 and its opposite free edge, the sleeve 9 comprises internally a ring 21 extending in a plane perpendicular to the axis of the sleeve 9 and whose function will be indicated below. The lower free edge 22 of the ring 21 is chamfered.

Between the ring 21 and the upper free edge of the sleeve 9 are two identical external grooves 23, 24 whose trapezoidal cross-section is complementary to that of the bead 16, the upper groove 23 being situated near the upper free edge of the sleeve 9 and the lower groove 24 being arranged slightly above the level of the ring 21.

Moreover, the sleeve 9 comprises externally, starting from the lower edge of the groove 24 and extending towards the flange 19, splines 25 which extend over a relatively short distance which is slightly less than that separating the lower edge of the splines 17 of the closing cap 3 and the lower free edge of the cap 3.

Furthermore, between the ring 21 and the flange 19, the sleeve 9 comprises, on the one hand, an internal thread 26 complementary to the thread 7 carried by the neck 6 of the bottle 2 and, on the other hand, an internal annular boss 27 situated on the side of the ring 21 slightly above the zone of the thread 26.

The applicator device 10, made of a plastic material, comprises a stem 28 which, in the conventional way, carries at its distal end a brush 29. The length of the stem 28 is such that when the bottle 2 is closed by the cap 3, the lower free end of the brush 29 arrives near the bottom of the bottle 2. At its proximal end, remote from the brush 29, the thickness of the stem 28 gradually increases to constitute an external conical wall 30 which forms the transition between the stem 28 and a conical element 31 coaxial therewith. Two opposite openings 32 in this conical element 31 are each delimited by a cylindrical wall having its axis parallel with the stem 28, these openings 32 communicating the interior of the element 31 with the space surrounding the stem 28.

Moreover, the conical element 31 terminates in a projection 33 which is disposed perpendicular to the axis of the stem 28 and whose external edge is bent at right angles on the side of the stem 28 to constitute a skirt 34 extending beyond the transition zone between the stem 28 and the conical element 31. The skirt 34 is bent outwardly at right angles along its free edge so as to form a collar 35 intended to abut the edge of the neck 6 in the closed condition of the bottle 2.

The skirt 34 comprises an external annular bead 36 near the collar 35, as well as two other internal annular sealing beads 37, near the projection 33.

The integrity ring 11 is constituted by a cylindrical element made of a frangible plastic material and joined, as may be seen in FIG. 1 to a tab 38 which, when the ring 11 is in position, is attached to a peripheral bead 39 of the bottle 2 in the vicinity of the shoulder 5 separating the body 4 of the bottle 2 from its neck 6. The user may easily grasp this tab to tear off the ring 11 when the bottle 2 is used for the first time.

The unit 1 is completed by a film, in this case an aluminium foil 40, which is applied and fixed to the projection 33 and which, before the first use, sealingly closes the circular opening 33*a* delimited by the internal edge of the projection 33.

The assembly and preparation of the storage and dispensing unit 1 are effected as follows:

First of all the integrity ring 11 is slid over the sleeve 9 until the free lower edge of the integrity ring bears on the bearing surface 20 of the flange 19 of the said sleeve 9. Then the closing cap 8 is applied over the sleeve 9 so that the internal bead 16 of the cap 8 becomes catch-engaged in the upper groove 23 of the sleeve 9. In this position, the lower edges of the splines 17 of the skirt 12 of cap 8 are situated slightly above the level of the lower edge of the groove 24, and the free lower edge of the skirt 12 is positioned slightly above the upper edge of the integrity ring 11 whose external wall is positioned in the extension of the skirt 12.

The sub-assembly constituted by the sleeve 9, the cap 8 and the integrity ring 11 is then upended and an appropriate quantity of an additional product 41 intended for nail treatment is introduced into the space delimited by the top 14 and the internal skirt 13 of the cap 8 such that the level of the additional product 41 is no higher than, or is only slightly higher than, the free end of the perforator 15.

Then, the applicator device 10, fitted with its brush 29 and having had the aluminium foil 40 fixed on the projection 33 by heat sealing, is placed in position. This positioning of the applicator device 10 is effected by inserting the skirt 34 of the device 10 into the opening delimited by the skirt 13 of the cap 8 until the flange 35 of the skirt 34 abuts against the lower annular wall of the internal ring 21 of the sleeve 9.

The sleeve 9 and the applicator device 10 are then fixed to each other by positioning the bead 27 of sleeve 9 under the lower side of the flange 35, with the lower side of the bead 36 of the skirt 34 of the device 10 which comes to be positioned above the upper side of the ring 21 in the orientation shown in the drawings.

In the fitted position of the applicator device 10, the additional product 41 is trapped in an enclosure between on the one hand the top 14 and the skirt 13 of the cap 8, and, on the other hand, the aluminium foil 40, the upper bead 37 carried by the skirt 34 of the device 10 ensuring the seal of this enclose.

The stoppering device 3, thus constituted, is then merely screwed on the bottle 2 into which the nail varnish 42 constituting the basic product has been introduced in the usual manner. In this closed position, the seal of the bottle 2 is ensured by the flange 35 bearing on the upper edge of neck 6 of the bottle 2.

The unit 1 is extremely simple to use because, after removing the integrity ring 11, the user merely depresses the cap 8 along the axis of the unit 1. At the start of this pressing down movement, the bead 16 of the cap 8 disengages from the groove 23, to come to be positioned at the end of the translational movement of the cap in the lower groove 24, as represented in FIG. 3. During this movement, the perforator 15 pierces the aluminium foil 40 thus releasing the additional product 41 which drops into the interior of the bottle 2, through the openings 32 of the conical element 31, to come to be mixed with the varnish 42. However, the user must then shake the unit 1 to ensure proper mixing of the varnish 42 and of the additional product 41 added thereto.

In the position which the closing cap 8 finally occupies in relation to the sleeve 9 and the applicator device 10, the splines 17 of the cap 8 have engaged between the splines 25 of the sleeve 9 with the result that rotational motion imparted to the cap 8 is transmitted to the sleeve 9 which threadedly cooperates with the neck 6 of the bottle 2.

It may also be stressed that the upper portion of the applicator device 10 on the opposite side to the brush 29 fulfill the function of a sliding piston during the action of lowering the cap 8 inside the skirt 13 and thus drives the whole of the additional product 41 to flow out easily through the openings 32, even if the additional product 41 has a high viscosity.

It shall be duly understood that the embodiment described above is in no way restrictive and may give rise to any desirable modifications without thereby departing from the scope of the invention.

I claim:

1. In a unit for storing and applying on a base a product with a consistency ranging from liquid to pasty such unit comprising:

(a) a reservoir for said product;

(b) detachable stoppering device adapted to be fitted on said reservoir;

(c) an applicator device integral with said detachable stoppering device, said applicator device comprising a stem, and an applicator element attached to the distal end of said stem for use in taking said product out of the reservoir and carrying it and spreading it on a said base, said stoppering device and said reservoir comprising co-operating means for effecting a stoppering seal of the reservoir;

the improvement wherein the stoppering device comprises:

(i) a first part which comprises means for fitting said stoppering device on said reservoir and with which the applicator device is integral;

(ii) a second part including means defining at least one compartment for at least one additional product intended to be admixed with a product to be contained in the reservoir, such admixture being intended to occur at the time of first use of the unit;

(iii) means mounting said second part displaceably in relation to said first part for displacement under the user's manual action upon the first use of the said unit between a first position which the second part adopts when said at least one compartment is obturated in a leakproof manner, and a second position wherein said at least one compartment has opened to communicate with the interior or said reservoir and to allow the contents of the said at lest one compartment to drop into said unit during the above-mentioned displacement from the first position to the second position; and (iv) fixing means for fixing said first and second parts of the stoppering device to each other when said second part is in said second position with a view to withdrawing said stoppering device from said reservoir for use of a said product combined in said reservoir with said at least one additional product;

said first part of the stoppering device comprising a sleeve, a means fixing said applicator device to said sleeve, said sleeve comprising, at its lower portion, means for fitting said sleeve to the reservoir; said second part of said stoppering device comprising a closing cap comprising a top, a peripheral skirt joined to said top and means permitting said skirt to slide in relation to the upper region of said sleeve and comprising first fastening means on said closing cap and complementary second fastening means on said sleeve for the attachment of said cap on said sleeve alternately in the first position and in the second position;

said closing cap including an internal skirt coaxial with said peripheral skirt and joined to said top;

said unit including a single said compartment for an additional product, said single compartment being delimited by the top of said closing cap and by said internal skirt; said applicator device comprising in the transition zone between said stem and said sleeve a skirt capable of sliding in a leakproof manner in relation to said internal skirt of said cap, said zone having at lest one opening capable of communicating the interior of said at least one compartment for an additional product with said reservoir, said applicator device including an annular projection joined to the skirt of the applicator device, a foil being applied to said annular projection to close said compartment for the additional product;

said cap including a perforator carried on the top of said cap and capable of piercing said foil, said applicator device including a wall which joins said projection to said stem and which defines said at least one opening;

said sleeve having an upper portion which is spaced radially outwardly from said skirt of said applicator device to define an annular chamber for receiving said internal skirt of said closing cap, said chamber having a length dimension sufficient to allow said top of said closing cap to engage said projection upon said displacement from said first to said second position so that substantially all of the contents of said one compartment will be discharged therefrom.

2. A unit according to claim 1, further comprising means preventing an untimely actuation of the second part of the stoppering device during storage before the first use.

3. A unit according to claim 1, wherein the first fastening means comprises an annular bead carried by the peripheral skirt of the cap and the second fastening means comprises means defining two parallel grooves at axially spaced locations along the sleeve.

4. A unit according to claim 1, wherein the peripheral skirt of the closing cap is external to the sleeve; wherein a means preventing untimely actuation of said cap during storage before the first use is provided and comprises an easily frangible integrity ring situated in the extension of said skirt; and wherein said sleeve includes a flange positioned to be abutted by said integrity ring.

5. A unit according to claim 4, including co-operating thread means on said stoppering device and said reservoir; wherein in said fixing means for fixing the first and second parts of the stoppering device to each other in said second position comprising splines carried respectively by the peripheral skirt of the cap and by the sleeve and being capable of inter-engaging in said second position of the second part of the stoppering device.

6. A unit according to claim 1, including co-operating thread means on said stoppering device and said reservoir; wherein said fixing means for fixing the first and second parts of the stoppering device to each other in said second position comprising splines carried respectively by the peripheral skirt of the cap and by the sleeve and being capable of inter-engaging in said second position of the second part of the stoppering device.

7. A unit according to claim I, including an annular flange on the end of the skirt of the applicator device opposite to the projection, said annular flange being effective to provide a stoppering seal of the reservoir; and including a ring of the sleeve co-operating with said flange for fixing the sleeve to the applicator device.

* * * * *